United States Patent [19]

Seino et al.

[11] 4,340,656

[45] Jul. 20, 1982

[54] ELECTROPHOTOGRAPHIC COPYING METHOD WITH RESIDUAL CHARGE ERASING STEP

[75] Inventors: Kuniki Seino, Aichi; Yoshihiro Ozaki, Isehara, both of Japan

[73] Assignee: Minolta Camera Kabushiki Kaisha, Osaka, Japan

[21] Appl. No.: 25,296

[22] Filed: Mar. 30, 1979

[30] Foreign Application Priority Data

Apr. 7, 1978 [JP] Japan ..... 53/41520
Apr. 7, 1978 [JP] Japan ..... 53/41521

[51] Int. Cl.[3] ..... G03G 13/18; G03G 13/22

[52] U.S. Cl. ..... 430/48; 430/55; 430/125; 361/212

[58] Field of Search ..... 96/1 SD, 1 TE, 1 C, 96/1.4; 355/16; 430/55; 361/212, 225

[56] References Cited

U.S. PATENT DOCUMENTS

| | | | |
|---|---|---|---|
| 2,777,955 | 1/1957 | Walkup | 250/49.5 |
| 2,825,814 | 3/1958 | Walkup | 250/49.5 |
| 2,937,943 | 5/1960 | Walkup | 96/1 R |
| 3,502,408 | 3/1970 | Brodie | 355/16 |
| 3,626,260 | 12/1971 | Kimura | 361/225 |

FOREIGN PATENT DOCUMENTS

| | | | |
|---|---|---|---|
| 49-53044 | 5/1974 | Japan | 96/1 R |

OTHER PUBLICATIONS

Schaffert Electrophotography, 1975, p. 167.

*Primary Examiner*—John E. Kittle
*Assistant Examiner*—John L. Goodrow
*Attorney, Agent, or Firm*—Wolder, Gross & Yavner

[57] ABSTRACT

A residual charge erasing step in the electrophotographic process in which a transparent conductor backed photoconductor layer positioned in virtual contact with a conductor backed dielectric layer is exposed to a light image while a first voltage is applied between the conductors to produce on the dielectric layer an electrostatic latent image, the erasing step which is applied after the transfer of the latent image includes positioning the photoconductor and dielectric layers in virtual contact, illuminating the full surface of the photoconductor layer and applying between the conductors a second voltage of a polarity opposite to the first voltage and whose value is $$((\chi a+\chi d)/\chi a)(312+6.2\ \chi a)$$

wherein $\chi a$ and $\chi d$ are respectively the capacitive air gap equivalent thicknesses in microns between the virtually contacting layers and of the dielectric layer per se. Where residual charges of opposite polarities occurs such as where the dielectric member is precharged, erasing voltages of the above value are alternately applied at opposite polarities.

4 Claims, 7 Drawing Figures

ELECTROPHOTOGRAPHIC COPYING METHOD WITH RESIDUAL CHARGE ERASING STEP

BACKGROUND OF THE INVENTION

The present invention relates generally to improvements in electrophotographic copying methods including the step of erasing residual charges from the electrostatic image carrying dielectric member and it relates more particularly to an improved copying method with a residual charge erasing step for repeatedly using the dielectric member in a simultaneous charge transfer process.

Simultaneous charge transfer methods are described in U.S. Pat. No. 2,825,814, issued Mar. 4, 1958, in which there is employed a photosensitive member including a photoconductive layer on a light transparent electrode plate (normally a NESA treated glass plate) and an electrostatic charge receiving dielectric member in the form of a belt including a few micron thick layer of highly electrically insulating dielectric material formed on a flexible electrode. The surface of the photoconductive layer of a photosensitive member is firmly held in face-to-face contact with the surface of the dielectric layer and following this, a direct current voltage of 500 to 1000 volts is applied between the photoconductive layer carrying light transparent electrode plate of the photosensitive member and the flexible electrode simultaneously with the exposure of the photoconductive layer by the projection of a light image on the back of a photosensitive member so as to form a latent electrostatic image on the surface of the dielectric layer. Furthermore, the use of electrostatic transfer paper in which a dielectric layer of high electrical resistivity is superimposed on an electroconductive layer of high resistivity instead of a dielectric belt is described in U.S. Pat. No. 3,502,408, issued Mar. 24, 1970. Among the advantages and features of the simultaneous charge transfer process are that a positive electrostatic latent image can be formed from a negative original, that a latent image can be formed in short periods of time without requiring a number of steps, and that a high voltage source of the order of a couple of thousand volts, such as for a corona discharge device, is not required.

In the aforesaid process, while the electrostatic latent image formed on the dielectric member is normally developed and fixed to become a permanent copy, a developed image on the dielectric member may be transferred onto, for example, a plain copy paper and is then fixed to become a permanent copy. The dielectric member, after transfer, is then subjected to the steps of cleaning and erasing of the residual developer and charges so that the dielectric member can be repeatedly used. Conventional means for effecting the removal of the residual charges with the use of an A.C. corona discharge device is described in U.S. Pat. No. 2,777,957 and the use of a metallic roller carrying a biasing voltage and contacting the surface where the residual charges are present is described in Japanese Laid Open Patent Application No. SHO49-53044. However, these residual charge removing means require special devices as erasing means and that their operations are quite complicated and difficult to control.

In the image forming mechanism of the simultaneous charge transfer process, there is, however, the disadvantage that the transfer efficiency of the image at an air gap of less than 5 microns or over 40 microns between the photoconductive layer and charge receiving dielectric member sharply deteriorates so that the normal techniques used to contact the photosensitive member face-to-face with the dielectric member results in blurs in the image density of the final image. To avoid this, the voltage applied between the photosensitive member and the dielectric member may be increased so that the photosensitivity rises to reduce the blurs in image density. However, this tends to cause the non-exposed portion on the surface of a dielectric member to become charged thereby rendering the final copy foggy.

While there have been proposed various methods to solve these drawbacks, one of the most practical solutions is to charge the surface of the dielectric member with charges of a specific polarity and then subjecting it to the image forming step wherein a voltage of a polarity opposite to the polarity of the charges on the dielectric member is applied simultaneously with exposure to the light image. Thus, the dielectric member charged on its surface before exposure will have charges of opposite polarities respectively on the portions corresponding to exposed and non-exposed areas upon the formation of an electrostatic latent image. With this latent image developed and transferred onto a paper, charges of positive and negative polarities will remain on the surface of the dielectric member. Accordingly, in order to obtain an image of high contrast and free of fog, it is necessary to erase residual charges of both positive and negative polarities thereby rendering the erasing operation more complicated to control than in the case of erasing of charges of only single polarity.

SUMMARY OF THE INVENTION

It is accordingly a primary object of the present invention to provide an improved electrophotographic copying method including a residual charge erasing step in a simultaneous charge transfer process.

Another object of the present invention is to provide an improved electrostatic copying method which includes an erasing step for erasing residual charges from an electrostatic charge receiving dielectric member to allow the same to be used repeatedly in a simultaneous charge transfer process.

Still another object of the present invention is to provide an improved electrophotographic copying method including a residual charge erasing step capable of erasing charges of single as well as both positive and negative polarities from the dielectric member.

The above and other objects of the present invention are achieved by providing an electrophotographic copying method in accordance with the present invention in which an electrostatic charge receiving dielectric member is held in face-to-face virtual contact with a photosensitive member, the method comprising at least the steps of producing an electrostatic latent image on and of erasing residual charges from the dielectric member wherein a voltage of a specific polarity opposite to the polarity of the charges remaining on the dielectric member is applied between the photosensitive member and the dielectric member when residual charges of only single polarity remain and voltages of both positive and negative polarities are alternately applied when charges of both polarities remain while effecting illumination of the photosensitive member simultaneously therewith.

For a fuller understanding of the nature and objects of the present invention, reference is made to the following detailed description taken in conjunction with the accompanying drawings.

DESCRIPTION OF THE PREFERRED EMBODIMENTS

Figure 1:
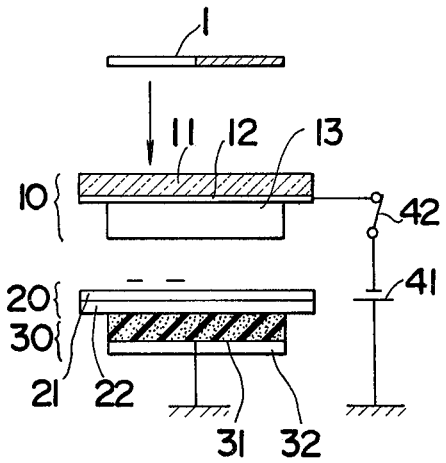
FIG.1 PRIOR ART
FIG. 1 is a diagrammatic view of a conventional electrostatic latent image forming mechanism employing the simultaneous charge transfer process.

Referring now to FIG. 1 in which there is shown an electrostatic latent image forming mechanism employing the simultaneous charge transfer process of the nature described in U.S. Pat. Nos. 2,825,814 and 3,502,408, an electrophotographic sensitive member 10 in a form of a sheet is held uniformly in face-to-face contact, confronting or facewise with an electrostatic charge receiving dielectric member 20 (these being shown as remote from each other in the drawings for convenience of illustration). The photosensitive member 10 includes a light transparent glass base 11, an electrode layer or plate 12 of light transparent and electroconductive material such as NESA glass (registered trademark) superimposed on said base and a photoconductive layer 13 superimposed on plate 12. The dielectric member 20 includes a dielectric layer 21 coated on over an electroconductive layer 22.

It is believed that even in the situation where the dielectric member 20 and the photosensitive member 10 are intimately held in face-to-face or confronting contact with each other, there exists an air gap of about 5 to 15 microns, in average, between the two contronting faces due to their respective surface roughness, non-uniformity in holding them in even contact and for other reasons. Thus, the confronting contact of the photosensitive member and the dielectric member will be referred hereinafter as "virtual contact".

The numeral 30 designates a pressure member consisting of pressing plate 32 and a superimposed electroconductive elastic pad 31 of sponge foam or the like for effecting the virtual contact between the dielectric member 20 and the surface of photoconductive layer 13 of photosensitive member 10. The photosensitive member 10 is electrically connected by electrode plate 12 to a direct current voltage source 41 through a switch 42 whereas the dielectric member 20 is electrically grounded through the pressure member 30. An original 1 to be copied is placed on a suitable support (not shown) over the photosensitive member 10 with the image thereof exposed by a light source (not shown) and projected by a suitable optical system (not shown), onto the back of photosensitive member 10. To form an electrostatic latent image on the dielectric member, the photosensitive member 10 and the dielectric member 20 are brought into virtual contact and then the switch 42 is closed to apply a direct current voltage of, for example, about 500 to 1000 volts between the electrode plate 12 and the electroconductive elastic pad 31 from the voltage source 41 and simultaneously with this, the image of original 1 is exposed and projected to the photosensitive member from the rear face thereof. An electrostatic latent image is thereby formed on the dielectric member so that the same may be developed to obtain a positive copy from a negative original.

A general explanation of the simultaneous charge transfer process for forming an electrostatic latent image is that the application of a voltage to the photosensitive member simultaneously with light or radiation exposure thereof by an image of an original causes holes and electrons to be generated in the light illuminated areas within the photoconductive layer 13 thereby causing polarization of the photoconductive layer 13. As a consequence, the potential difference in the air gap between the dielectric member 20 confronting the light illuminated portions of the photoconductive layer 13 rises and when this difference exceeds the discharge initiating voltage as determined by Paschen's Law, air breakdown discharges occur and electrons or ions generated thereby are transferred onto the dielectric member 20. Thus, there is formed a latent image on the dielectric member with charges on the portions corresponding to light illuminated portions of the photoconductive layer.

Another method of forming an electrostatic latent image is to initially charge the surface of the dielectric member to a polarity opposite to that of electrostatic latent image and then, the voltage is applied between the photosensitive member and dielectric member simultaneously with the exposure to the radiation or light image in the manner described above. The final latent image formed will have charges of a first polarity on the portions corresponding to the light illuminated areas and of a second polarity on the portions corresponding to the non-illuminated areas. With this procedure, images of better contrast and less fog are obtained.

There are various methods for charging the surface of the dielectric member one of which is with the use of a corona discharge device. Specifically, a corona discharge device connected to a voltage source is moved across the surface of the dielectric member (or visa versa) to charge the dielectric member to a polarity opposite to the polarity of the latent image which is to be formed in the succeeding step. Another method of charging the entire surface of the dielectric member which is described in U.S. Pat. No. 2,937,943 is to apply a voltage of a polarity opposite to the polarity of the latent image between the photosensitive member and the dielectric member with both members being held in virtual contact with one another and exposing the photosensitive member to light simultaneously therewith. Specifically, the dielectric member is brought into facewise virtual contact with the photosensitive member and a direct current voltage is applied therebetween simultaneously with the full surface illumination of the photosensitive member from the rear face thereof. By this, holes and electrons are generated in the photoconductive layer of the photosensitive member thereby causing polarization therein. In consequence, the potential difference in the air gap between the photosensitive member and the dielectric member rises and when this difference exceeds the discharge initiating voltage as determined by Paschen Law, air breakdown discharges occur to cause the transfer of charges on the surface of the dielectric member thereby charging the same. Following this step, a voltage of opposite polarity is applied between the photosensitive member and the dielectric member simultaneously with an exposure of an image to form an electrostatic latent image.

In either of the methods used to form a latent image, i.e., whether the surface of the dielectric member is charged or uncharged, there will be at least charges of either polarity remaining. This becomes a problem if the dielectric member is to be used repeatedly. Specifically, if the dielectric member bearing an electrostatic latent image is developed with a toner and then the developed image is transferred onto copying paper, there will be residual charges on the dielectric member and these must be erased in order to form the next latent image on the dielectric member.

Figure 2A:
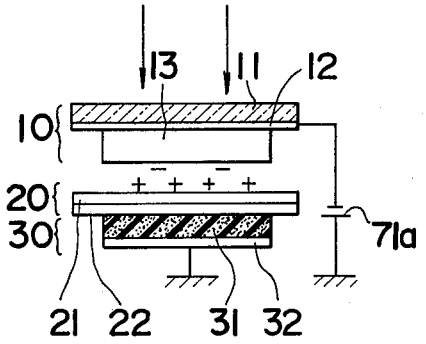
FIGS. 2*a* and 2*b* are diagrammatic views illustrating the steps of erasing residual charges from an electrostatic charge receiving dielectric member in accordance with the present invention.
Figure 2B:
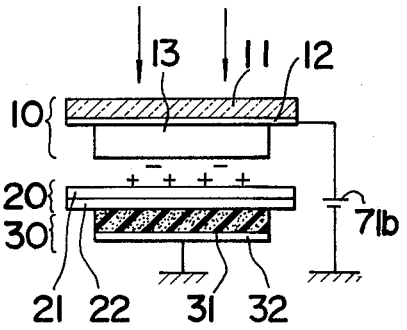

In the erasing step in accordance with the present invention for erasing residual charges from dielectric members, voltage to be applied between the photosensitive member and dielectric member which are held in virtual contact with one another is set to a value or amount Vap sufficient to cause air breakdown discharges therebetween under certain exposure (illumination) of the photosensitive member and the voltage Vap of at least a polarity opposite to the latent image is applied simultaneously with full surface illumination of the photosensitive member. More specifically, a voltage of a polarity opposite to the previously formed latent image is applied to the electrode plate 12 from a voltage source 71*a* simultaneously with the full surface illumination of the photosensitive member 10 from a rear face thereof as shown in FIG. 2*a*. This erases residual charges of the latent image. If the surface of the dielectric member 20 was charged to a polarity opposite to the polarity of the latent image as in the manner described above, then a voltage of a polarity, the same as the polarity of the latent image is applied to the electrode plate 12 from voltage source 71*b* while continuing illumination of the photosensitive member 10 as shown in FIG. 2*b*. Thus, with positive and negative charges remaining, voltages of positive and negative polarities are applied alternately with illumination being simultaneously effected.

Figure 3:
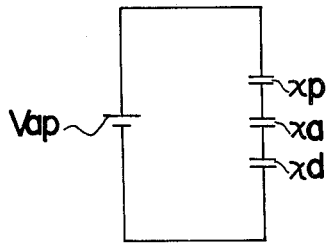
FIG. 3 is an equivalent circuit diagram corresponding to electrostatic latent image forming mechanism shown in FIG. 1.

In determining the applied voltage Vap of positive and negative polarities, the structure of the simultaneous charge transfer mechanism shown in FIG. 1 or FIG. 2 may be replaced with the equivalent circuit shown in FIG. 3 by representing the photosensitive member, the air gap and the dielectric member respectively, as respective condensers. In the circuit of FIG. 3, $\chi p$, $\chi a$, and $\chi d$ each respectively represent an air gap of equivalent thickness, in microns, of photoconductive layer 13, of the air gap between the photosensitive member 10 and dielectric member 20 and of the dielectric member itself. The air gap equivalent thicknesses $\chi p$, $\chi a$, and $\chi d$ are obtained by assuming the photoconductive layer 13, the air gap and the dielectric layer 21 respectively as dielectrics and defined by the equation of $\chi = d/\epsilon$ wherein d is the thickness of the respective dielectrics and $\epsilon$ is the dielectric constant of the respective dielectrics. Additionally, electrostatic capacity C (in units of $pF/cm^2$) of the respective dielectrics are in the relation of $C = 885/\chi$. Further, Vap in FIG. 3 represents the applied voltage and the air breakdown discharge initiating voltage in accordance with Paschen Law, is in relation of $312 + 6.2\chi a$.

From the foregoing, it can be said that if the illumination intensity at the time of full surface illumination in the erasing step is sufficiently high, that the resistivity of photoconductive layer 13 can be regarded to be substantially zero, then the transferred surface potential VT on the dielectric member 20 is represented by the following equation regardless of the time in which voltage is applied. It should be noted that the dielectric layer 21 is charged to a potential of +Vto, i.e., the residual potential is +Vto and that voltage to be applied in the erasing step may be assumed to be of negative polarity. This is to say that the equation is only concerned with voltage Vap to be applied when residual charges on the dielectric member 20 are of positive polarity.

$$VT = Vto + \{-Vap + ((\chi a + \chi d)/\chi a)(312 + 6.2\chi a + (-\chi a/(\chi a + \chi d))Vto)\} \quad \ldots a$$

Arranging this equation, it becomes as follows:

$$VT = Vap + ((\chi a + \chi d)/\chi a)(312 + 6.2\chi a) \quad \ldots b$$

To make the residual potential of positive polarity on the dielectric member 20 zero, this apparently means that VT should become zero in the equation b. Accordingly, voltage to be applied in the erasing step to erase charges of positive polarity is:

$$-Vap = -((\chi a + \chi d)/\chi a)(312 + 6.2\chi a) \quad \ldots (I)$$

Further, the sign of the variable in the above equation (I) may merely be changed to erase residual charges of a negative polarity.

From the foregoing, it is clear that by the applications of voltages Vap and −Vap in accordance with equation (I) alternately while simultaneously effecting full surface illumination, VT is always brought down to a value of zero, i.e., the residual potentials or charges are completely erased regardless of the amounts or values of the potentials (Vto, −Vto) of both positive and negative polarities on the dielectric member 20. Similarly, if charges of only a specific or single polarity remain, then Vap of an opposite polarity is applied simultaneously with illumination.

Since voltages of both positive and negative polarities are applied, the photoconductive layer 13 used should have a photosensitivity to both polarities.

It will be noted that the applied voltages Vap and −Vap are not necessarily required to be set to the identical values calculated by equation (I), but may be set with certain freedom or tolerance. Thus, even if the applied voltages Vap, −Vap were set higher to cause dielectric member 20 to become charged, there will be no problem as long as the charged potentials are low enough that the charged surface will not be developed by toner when passing through the developing means.

The following examples of erasing steps are given merely by way of illustration.

EXAMPLE 1

The photosensitive member 10 was prepared by forming a photoconductive layer 13 of about 30 microns thickness on an electroconductive layer 12 which in turn was formed by NESA treating the surface of a glass plate 11 of 5 mm thick. The photoconductive material used is a photoconductive powder of $CdS.nCdCO_3$ ($0.8 \leqq n \leqq 1$) which together with a metallic activator is dispersed in acryl binder resin. The air gap equivalent thickness $\chi p$ of this photoconductive layer 13 was determined to be 3.8. As the dielectric member 20, a dielectric layer 21 of acryl resin coated over an electroconductive sheet 22 was used. Its air gap equivalent thickness $\chi d$ was 1.2. As to $\chi a$, the average value was determined to be 6.5.

With the photosensitive member and dielectric member held in virtual contact with one another, the following experiments were conducted to confirm the effects of the erasing step of the present invention. With no charges on the dielectric layer, i.e., with the surface potential of dielectric member 20 being zero, full surface illumination from the rear of the photosensitive member, was effected at an illumination intensity of 960 lux simultaneously with the application of a voltage between the photosensitive member and dielectric member. Voltages applied were varied stepwise with voltage applied time maintained at 0.1 second. As a result, a transfer of charges occurred at applied voltage of about −420 volts as shown by □ marks in FIG. 4. Thus, this apparently indicates that the applied voltage Vap is about −420 volts.

Next, the dielectric member having surface potential of about +70 volts (i.e., a residual potential of +70 volts) is brought into virtual contact with the photosensitive member and the voltage was applied to effect transfer of charges while simultaneously illuminating the photosensitive member at intensity of 970 lux. As can be seen by + marks in FIG. 4, positive charges on the dielectric member were neutralized at applied voltage of about −420 volts so that residual potential was brought down to zero. This apparently means that residual potential of 70 volts which is the difference of 0 and 70 volts was completely erased. With similar experiments conducted, but with residual potential of about −70 volts on the dielectric member, residual charges were completely erased by applying voltage of about +420 volts simultanously with full surface illumination at intensity of 970 lux.

Figure 4:
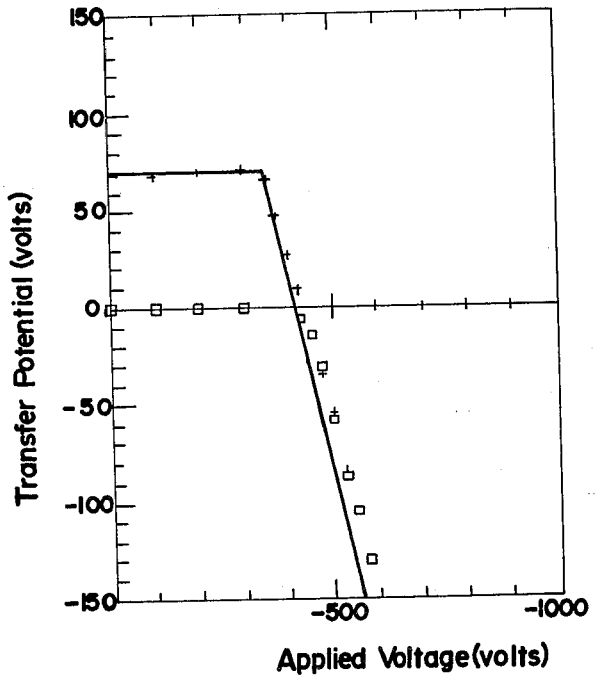
FIG. 4 is a graph showing the relation between residual transfer potentials and the applied voltage.

It should be noted that the solid line shown in FIG. 4 is the theoretical curve following the equation a.

Figure 5:
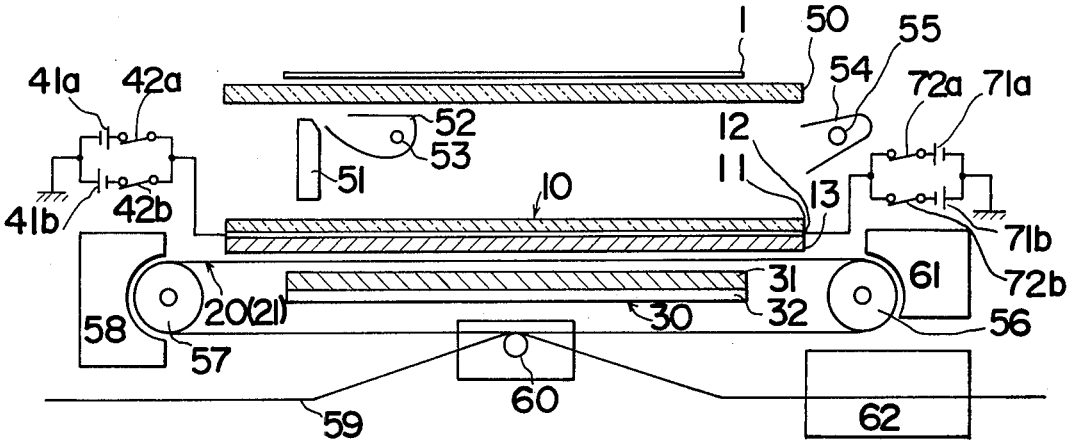
FIG. 5 is a diagrammatic view of a copying apparatus employing the copying method of the present invention and particularly suited for obtaining positive images from positive originals.
Figure 6:
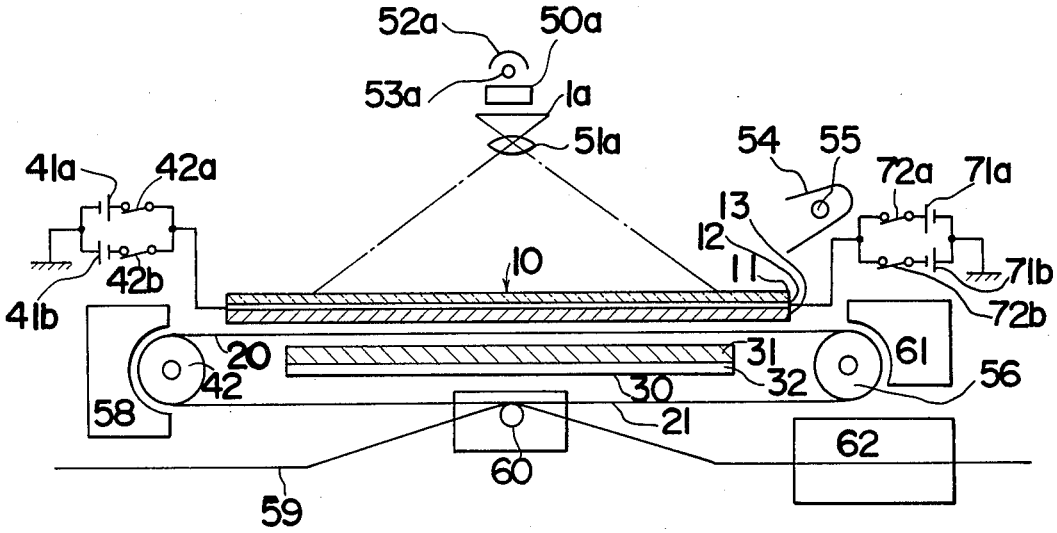
FIG. 6 is a diagrammatic view of another copying apparatus employing the copying method of the present invention and particularly suited for obtaining positive images from negative originals.

Specific constructions of copying apparatuses employing the electrophotographic copying method of the present invention are illustrated in FIGS. 5 and 6 to which reference is now made. In both illustrated apparatuses, the dielectric member is to be charged beforehand so that erasing of residual charges is effected for both positive and negative polarities. However, it should be noted that the invention is applicable to the case where the dielectric member is not pre-charged although such would only be useful for obtaining a positive image from a negative original.

Referring to FIG. 5, there is shown a slit or scanning exposure type copying apparatus for reproducing a positive image from an original positive image in which the original 1 in a form of a sheet or book is placed on a transparent, original support plate 50 and therebelow, there is located a reciprocatingly movable image transmitter 51 including a bundle of optical fibers of graded refractive index and an image exposure lamp 53 backed by a reflecting member 52. The image transmitter 51 together with the lamp 53 is moved for scanning the image along a path parallel to the original 1 and then returns upon completion of the scan to its initial position for the next scanning. Reference is made to U.S. Pat. No. 3,955,888 as an example of specific means to move the image transmitter 53, for scanning. In the vicinity of the terminal end of the scanning path of image transmitter 51, there is provided a light source 55 backed by a reflecting member 54 for use in the charging and erasing steps in which the photosensitive member 10 is illuminated from the rear thereof.

The photosensitive member 10 is in the form of a sheet, as has been earlier described and comprises a light transparent glass plate 11, a light transparent and electroconductive NESA electrode plate 12 and a photoconductive layer 13 and is disposed parallel to and below the original plate 50. The NESA electrode plate 12 is connectable to voltage sources **41*a* and 41*b* through normally open switches 42*a* and 42*b* and is also connectable to other voltage sources 71*a* and 71*b* through normally open switches 72*a* and 72*b***.

The electrostatic charge receiving dielectric member 20 is in the form of flexible endless belt rotatably supported by a pair of longitudinally spaced rollers 56, 57 and comprises a dielectric layer 21 overcoated on the outer face of an electroconductive rubber sheet or electroconductively treated Mylar film. As the material for dielectric layer 21, an acryl resin, Mylar film or other similar materials may be used and should preferably have a thickness of about 3 to 5 microns. The dielectric member 20 is normally stationary and pressed against the surface of photoconductive layer 13 by pressing means 30 consisting of an electroconductive sponge pad 31 over a pressing plate 32. It is noted that the dielectric member 20 is electrically grounded through the sponge pad 31 or through rollers 56, 57. As has been described, it is believed that there exists an air gap of about 5 to 15 microns in average between the dielectric member 20 and the photosensitive member 10 even if they are intimately contacted due to their surface roughnesses and unevennesses in uniform contact.

Provided around the dielectric member 20 in a form of a belt are a developing means 58 for developing an electrostatic latent image, an image transferring means 60 for transferring the developed image onto a plain copying paper 59 fed thereto and a cleaning means 61 for removing residual toner remaining on the dielectric member. Also in the path of copying paper 59, there is provided a fixing means 62 for fixing the transferred image. As for the developing means, any known type of developing method such as magnetic brush, cascade or even a wet type electrode method may be employed. Similarly, the image transferring means 60 may be a corona discharge device, an electroconductive roller applied with a biasing voltage or any other known means. As for cleaning means 61, a fur brush, elastic blade or other suitable means may be used.

In operation, the original 1 to be copied is placed on the original plate 50 and then the dielectric member 20 is brought into virtual contact with the photosensitive member 10. Upon actuation of a print switch (not shown), switch **42*a* is momentarily closed to apply a voltage of positive polarity, for example of 500 volts, between the photosensitive member 10 and dielectric member 20 simultaneously with the momentary energization of light source 55 for full surface illumination of the photosensitive member 10 from the rear face thereof. By this, air breakdown discharges take place in the air gap to charge the surface of dielectric member 20 with charges of positive polarity. Immediately thereafter, switch 42***a* is opened, light source 55 is deenergized and switch 42*b* is closed to apply a voltage of negative polarity between the photosensitive member 10 and dielectric member 20 from voltage source 41*b*. Simultaneously therewith, the exposure lamp 53 is energized and the image transmitter 51 together with the lamp 53 is moved in the direction to the right parallel to the original plate 50 to successively scan the image of original 1 and project it onto photosensitive member 10. By this, the latent image is formed on the dielectric member 20. The pressing means 30 urging the dielectric member 20 into virtual contact with the surface of photoconductive layer 13 is then released to separate the member 20. Simultaneously, the rollers 56, 57 are driven to move or advance the dielectric member 20. As the member 20 is advanced, the electrostatic latent image formed thereon is developed with toner by developing means 58 and then transferred to a copying paper 59 by image transferring means 60. The paper is thereafter fed to fixing means 62 to become permanent copy. Moreover, the dielectric member 20 is subjected to cleaning of residual toner by cleaning means as it passes thereby.

Upon termination of one full rotation, the rollers 56 and 57 are deenergized to stop the advance of dielectric member 20. Then the pressing means 30 is urged from the rear of the dielectric member 20 to bring the dielectric member 20 into virtual contact with the photosensitive member 10 to effect the erasing step for erasing residual charges of both positive and negative polarities. This is effected by energizing the light source 55 to illuminate the photosensitive member 10 and simultaneously therewith, voltage of a positive polarity is applied between the photosensitive member 10 and dielectric member 20 from voltage source 71*a* through the closing of switch 72*a* and immediately thereafter switch 72*a* is opened and switch 72*b* is closed to apply a voltage of negative polarity from source 71*b* while continuing illumination by light source 55 so as to erase positive charges. With the erasing step completed, a next copying operation may be conducted in the same manner. The values of the voltages applied from sources 71*a* and 71*b* are approximately or in the range of the charge erasing voltages earlier explained as represented by formula (I).

The apparatus shown in FIG. 6 is basically the same as that of FIG. 5 but is particularly suited for obtaining a positive image from an original of negative film. In the apparatus, the original, in a form of film, is placed between a condenser lens 50*a* and a projection lens 51*a* and exposed onto the photosensitive member 10 by an exposure lamp 53*a* backed by reflecting member 52*a*. The copying operation is basically similar to the apparatus of FIG. 5 where same reference numbers are used to to designate similar parts so that any detailed explanation of the operation of FIG. 6 is not necessary and will be omitted, it being noted that the process of producing a reverse copy is as earlier explained.

In summary, the copying method of the present invention is relatively simple and permits the repeated use of the dielectric member by the erasing step which merely requires the proper setting of the voltage value applied between the photosensitive member and the dielectric member. Accordingly, there is no need for any special means to effect the erasing of the residual charges and that the control thereof is relatively simple since only the application of a voltage of about the proper value and simultaneous illumination are required to effect erasing.

While there have been described preferred embodiments of the present invention, it is apparent that numerous alterations, additions and omissions may be made without departing from the spirit thereof.

We claim:

1. An electrophotographic copy method which comprises the steps of:

charging a surface of an electrostatic charge receiving dielectric member with charges of first polarity;

applying a direct current voltage of a second polarity between a photosensitive member, photosensitive to both positive and negative polarities and said dielectric member in face-to-face virtual contact therewith while projecting a light image of an original onto said photosensitive member so as to form an electrostatic latent image on the dielectric member; and applying a direct current voltage of opposite first and second polarities alternately between the photosensitive member and dielectric member while effecting the overall illumination of the photosensitive member simultaneously therewith so as to erase charges of both first and second polarities, the values of said alternately applied voltages being approximately $$((\chi a+\chi d)/a)(312+6.2\chi a)$$

wherein $\chi a$ and $\chi d$ are respectively the capacitive air gap equivalent thicknesses in microns of the air gap between the virtually contacting photosensitive and dielectric members and of the dielectric member itself.

2. An electrophotographic copying method which comprises:

the first step of charging a surface of an electrostatic charge receiving dielectric member with charges of a first polarity;

the second step of applying a direct current voltage of a second polarity between a photosensitive member and said dielectric member simultaneously with the exposure of said photosensitive member to a light image, said photosensitive member including a photoconductive layer photosensitive to both positive and negative polarities formed on an electrically conductive member and being held in face-to-face virtual contact with the dielectric member which includes a dielectric layer formed on an electrically conductive member;

the third step of separating the dielectric member from the photosensitive member and developing with toner the latent image formed on the dielectric member;

the fourth step of transferring the developed image onto a copying member;

the fifth step of cleaning residual toner from the dielectric member; and the sixth step of erasing residual charges of opposite first and second polarities from the dielectric member by alternately applying direct current voltages of respectively first and second polarities between the photosensitive and dielectric members while they are in virtual contact while simultaneously effecting the overall illumination of the photoconductive layer, the values of said voltages of first and second polarities being approximately $$((\chi a+\chi d)/\chi a)(312+6.2\chi a)$$

wherein $\chi a$ and $\chi d$ are respectively the capacitive air gap equivalent thicknesses in microns of the air gap between the virtually contacting photosensitive and dielectric members and of the dielectric layer itself.

3. The method as claimed in claim 2 wherein said first step is effected by applying a direct current voltage of said first polarity between the photosensitive and dielectric members while in virtual contact with one another while illuminating the photosensitive member.

4. A residual charge erasing method in the production of an electrostatic latent image in which a photosensitive member including a front photoconductive layer photosensitive to both positive and negative polarities and superimposed on a conductive backing and a dielectric member including a front dielectric layer superimposed on a conductive backing are positioned with said layers in separable confronting virtual contact and a voltage is applied between said members while exposing said photoconductive layer to a light image to produce on said dielectric layer an electrostatic latent image which is thereafter developed and cleaned leaving thereon residual charges of opposite polarities, said method of erasing residual charges including the steps of positioning said members with said layers in confronting virtual contact and simultaneously overall exposing said photoconductive layer to light and alternately applying first and second erasure voltages of respectively opposite polarities between said members of a predetermined value to substantially reduce said residual charges without establishing substantial charges on said dielectric layer of polarities opposite to that of said residual charges, said erasure voltage predetermined voltage being approximately $$((\chi a+\chi d)/\chi a)(312+6.2\chi a)$$

wherein $\chi a$ and $\chi d$ are the air gaps equivalents in microns between the virtually contacting photoconductor and dielectric layers and of said dielectric layer respectively.

* * * * *